US010312574B2

(12) United States Patent
Yen et al.

(10) Patent No.: US 10,312,574 B2
(45) Date of Patent: Jun. 4, 2019

(54) SELECTIVE SPECIFIC ABSORPTION RATE (SAR) MITIGATION

(71) Applicants: Chih-Chuan (Jorg) Yen, Vista (TW); Alan Pasion, Carlsbad, CA (US)

(72) Inventors: Chih-Chuan (Jorg) Yen, Vista (TW); Alan Pasion, Carlsbad, CA (US)

(73) Assignee: ARLO Technologies, Inc., Carlsbad, CA (US)

( * ) Notice: Subject to any disclaimer, the term of this patent is extended or adjusted under 35 U.S.C. 154(b) by 0 days.

(21) Appl. No.: 14/820,402

(22) Filed: Aug. 6, 2015

(65) Prior Publication Data

US 2017/0040680 A1 Feb. 9, 2017

(51) Int. Cl.
*H01Q 1/24* (2006.01)

(52) U.S. Cl.
CPC ..... *H01Q 1/245* (2013.01)

(58) Field of Classification Search
CPC ..... H01Q 1/52; H01Q 1/526; H01Q 1/245
See application file for complete search history.

(56) References Cited

U.S. PATENT DOCUMENTS

| | | | | |
|---|---|---|---|---|
| 9,350,077 | B1 * | 5/2016 | Zheng | H01Q 7/00 |
| 2008/0001831 | A1 * | 1/2008 | Park | H01Q 1/245 343/702 |
| 2013/0069847 | A1 * | 3/2013 | Chiang | H01Q 1/245 343/893 |

* cited by examiner

*Primary Examiner* — Robert Karacsony
(74) *Attorney, Agent, or Firm* — Manuel de la Cerra

(57) ABSTRACT

Systems, methods, and devices for reducing specific absorption rate (SAR) for an antenna are disclosed. An example method includes determining a location of a hotspot on a surface of the antenna, the hotspot comprising an area of increased SAR above a predetermined limit. The method further includes introducing a recess in the surface of the antenna at a recess location, the recess location based on the location and frequency characteristics of the hotspot. Example systems and devices include a surface forming an antenna structure and a recess in the surface of the antenna at a recess location, wherein the recess location would be a hotspot when the surface of the antenna is not recessed, the hotspot comprising an area of increased SAR above a predetermined limit.

15 Claims, 6 Drawing Sheets

SELECTIVE SPECIFIC ABSORPTION RATE (SAR) MITIGATION

1.0 TECHNICAL FIELD

The present invention relates to radio frequency (RF) communications, and more particularly, some examples relate to specific absorption rate (SAR) mitigation for antennas, antenna systems, or electronic devices including an antenna or antenna system.

2.0 BACKGROUND

Mobile communication devices, such as mobile telephone handsets, tablet based computers, laptop computers, and other electronic devices provide various functions to users such as telephone calling, emailing, surfing the World Wide Web, composing and sending text messages, interacting with mobile applications, and other functionality. Mobile communication devices may incorporate one or more antennas. These antennas generally radiate radio frequency (RF) energy to transmit information. In some instances, a human body may be exposed to this radiated RF energy, e.g., when a person talks on a mobile telephone handset.

Specific absorption rate (SAR) is a measure of the rate at which energy is absorbed by, for example, the human body, when exposed to a RF electromagnetic field, e.g., from a mobile communication device.

Mobile communication devices may be subject to SAR limits, e.g., limits on the rate at which energy will be absorbed by the human body when exposed to radiated RF energy from the mobile communication device. In many countries, to ensure that users of mobile communication devices are not exposed to unacceptable radiation levels, limits are placed on SAR. For example, the Federal Communications Commission (FCC) has SAR limits (FCC limits) in place in an effort to ensure that mobile communication device users are not exposed to unacceptable radiation levels.

Thus, one obstacle faced by mobile communication device manufacturers is to meet the SAR regulatory requirements for the particular country or countries where the mobile communication devices will be used.

Compliance with SAR limits might be achieved by fixing maximum RF transmit power for a mobile communication device to a power level that maintains legal compliance. Limiting transmit power, however, may underutilizes the capabilities of the mobile communication device and may adversely impact communication connections, communication quality, or both.

Compliance with SAR limits might also be achieved by adding additionally hardware, such as shielding to filter out any RF emissions that exceed SAR limits. Added hardware, such as added shielding to filter out RF emissions that exceed SAR limits, may add additional hardware to the antenna, extra weight due to the added hardware, or added cost for the hardware added to the antenna or antennas. Additionally, the use of shielding generally wastes energy because energy that could be transmitted is now blocked by the shield. Thus, the use of shielding may be less efficient and may impact over the air performance.

3.0 SUMMARY

In general, this disclosure describes techniques that reduce the Specific Absorption Rate (SAR) level of an antenna, antennas, antenna system, or electronic device including an antenna, antennas, or antenna system. In general, some techniques may reduce the SAR level by determining one or more SAR hotspots on one or more radiating elements of an antenna, antennas, or antenna system. Generally, SAR at the radiating element or elements is frequency dependent. Some examples provide a method to selectively modify the one or more radiating element such that SAR may be reduced and a low level of SAR may be achieved. As described herein, some examples relate to antenna, antennas, antenna systems, or electronic devices including antennas. Some examples relate to band or frequency selective SAR mitigation for embedded antenna system. Accordingly, in some examples, the locations of hotspots may be dependent on frequency or frequency band used.

In an example, a method of reducing SAR from an antenna include determining a location of a hotspot on a surface of the antenna, the hotspot comprising an area of increased SAR above a predetermined limit, and introducing a recess in the surface of the antenna at a recess location, the recess location based on the location of the hotspot.

In another example, an antenna with a reduced SAR may include a surface forming an antenna structure, and a recess in the surface of the antenna at a recess location, wherein the recess location would be a hotspot when the surface of the antenna is not recessed, the hotspot comprising an area of increased SAR above a predetermined limit.

In another example, an electronic device includes a transmitter, and an antenna coupled to the transmitter, the antenna having a reduced SAR, the antenna including a surface forming an antenna structure, and a recess in the surface of the antenna at a recess location, wherein the recess location would be a hotspot when the surface of the antenna is not recessed, the hotspot comprising an area of increased SAR above a predetermined limit. P Other aspects of the invention are disclosed herein as discussed in the following Drawings and Detailed Description.

4.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views, embodiments, or both. It will be understood that certain components and details may not appear in the figures to assist in more clearly describing the invention.

5.0 DETAILED DESCRIPTION

Figure 1:
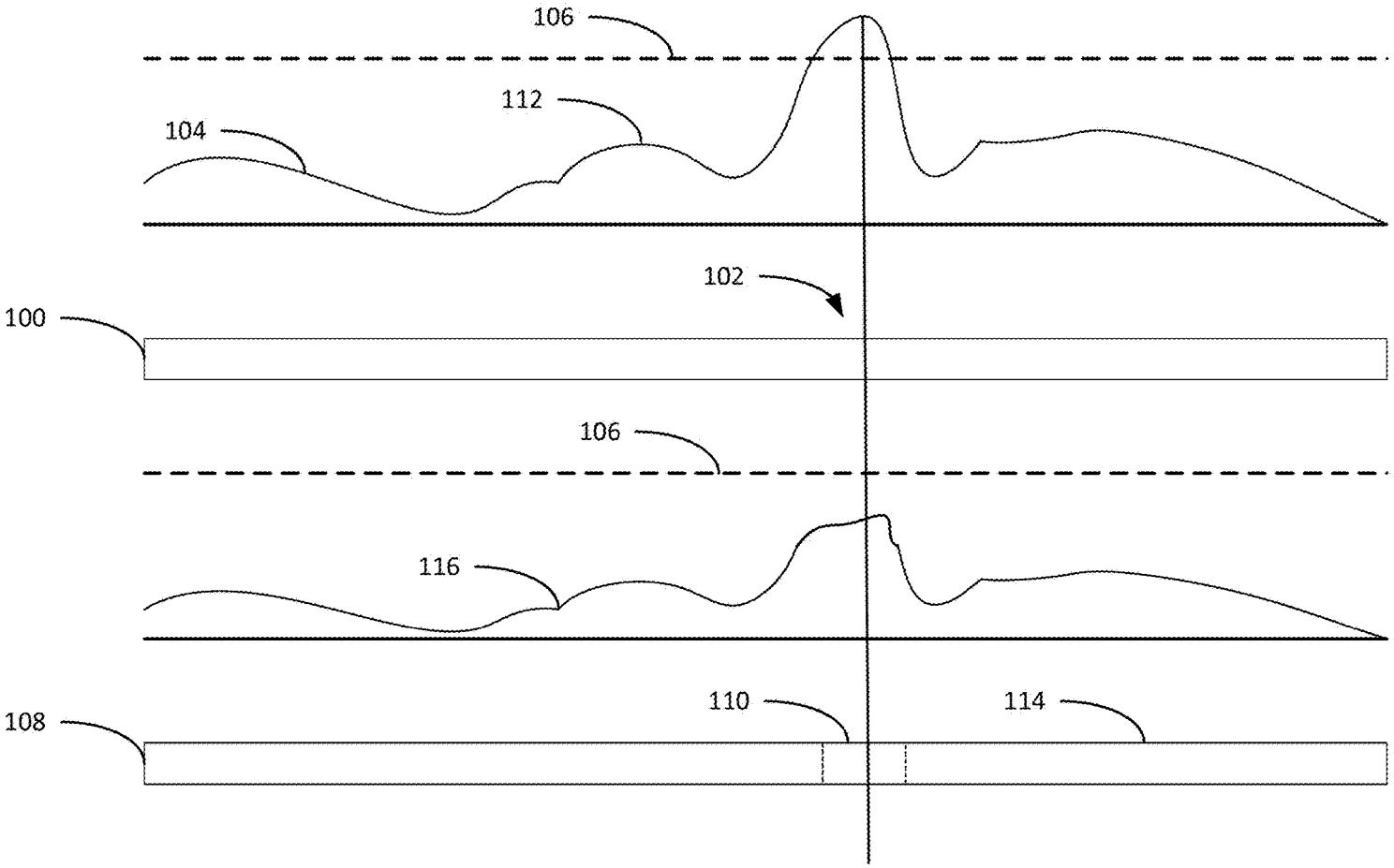
FIG. 1 is a diagram illustrating a Specific Absorption Rate (SAR) hotspot in accordance with the techniques described herein.

Following is a non-limiting written description of examples illustrating various aspects of this disclosure. These examples are provided to enable a person of ordinary skill in the art to practice the full scope of the disclosure without having to engage in an undue amount of experimentation. As will be apparent to persons skilled in the art, further modifications and adaptations can be made without departing from the spirit and scope of the invention, which is limited only by the claims.

As described herein, wireless devices are subject to Specific Absorption Rate (SAR) limits in many countries to ensure that device users are not exposed to unacceptable radiation levels. Some examples described herein relate to mitigation of SAR exposure based on antenna design. Some examples provide a way to reduce SAR level by tracing or determining one or more SAR hotspot on one or more radiating elements of an antenna system. The SAR for locations on the radiating element or radiating elements may generally be frequency dependent. Thus, hotspots for a particular antenna, antennas, or antenna system may vary based on transmission frequency or transmission band. Accordingly, the examples described herein may provide for band or frequency selective SAR mitigation. In other words, SAR mitigation used on an antenna or antenna system may vary based on an intended frequency for use by the antenna or antennas. In some examples, the systems and methods described herein may be used for band or frequency selective SAR mitigation for embedded antenna systems. Some examples provide systems, methods, antennas, and electronic devices to selectively modify one or more radiating element such that a low level of SAR is achieved.

Some examples of the systems and devices described herein may include one or more antennas and one or more parasitic elements associated with the one or more antennas. Together the antenna or antennas and the parasitic element or parasitic elements may form a complete radiating system. The systems and methods described herein may be applied to such complete radiating systems, e.g., antenna/parasitic element combinations.

SAR as a result of radiation in the near field generally decreases with separation distance from the radiating elements such as the antenna or antennas. Accordingly, RF energy absorbed, e.g., by a human body, may be reduced by increasing the distancing from the human body to areas causing high RF energy absorption by the human body, i.e., high SAR. In many cases, however, one may not simply move the entire antenna away from the likely position of a human body of a person using a mobile communication device. Rather, providing this increase in distance from areas that may cause high RF energy absorption by the human body may be done selectively for the particular areas causing high SAR. This increase in distance may be accomplished by introducing a recess in the surface of the antenna at a recess location. The recess location may be based on the location of a hotspot, which is a location on a surface of an antenna of increased SAR, e.g., above a predetermined limit. In some examples, the recess may be a complete removal of a portion of an antenna, such as a hole or notch through a portion of an antenna. The recess may be a notch down to move an area of high SAR out of the plane of the antenna (assuming an example using a planer antenna) or a planar portion of the antenna and away from a user of the device using an antenna designed using the techniques described herein. In other examples, the recess may be made by bending a location on a surface of an antenna of increased SAR away from an area of interest where SAR is measured.

As described above, the SAR measurement is a measure of the rate at which energy is absorbed by, for example, the human body, when exposed to a radio frequency (RF) electromagnetic field. The measurement may be made using engineering test equipment. Some examples of engineering test equipment that might be used to perform the measurements include, but are not limited to, iSAR box and 3D electromagnetic (EM) simulation tools like high frequency structural simulator (HFSS). HFSS is a commercial finite element method solver for electromagnetic structures. HFSS is made by Ansys, Inc.

In some examples, engineering test equipment, simulation tools, or both may be used to determine one or more hotspot locations caused by the denser current distribution. The hotspot location or hotspot locations on or along a surface of an antenna element or antenna elements may be frequency dependent. Thus, the testing or simulation may be performed for a specific frequency or band of frequencies. There may be one or more SAR hotspots that may exceed FCC or other regulatory limits, e.g., for a frequency or band of frequencies of interest, and would need some countermeasure to reduce the intensity in order to meet compliance. In some examples, SAR hotspots may typically concentrate on one of many test surfaces that are closest to the antenna element with high current density.

In some examples, a recess on a 3D structure of an antenna may be introduced to increase separation distance from a radiating source to a test surface, which essentially reduce the SAR intensity that may be detected by a measurement system or simulated by a simulation system. The depth of a recess may be determined by a SAR level, measured or simulated, on an opposite side of an antenna being tested or simulated in accordance with the methods described herein. In some examples, when the SAR level on the opposite side of a surface is weaker, a deeper recess might still be utilized to allow for more SAR reduction to allow for greater margin between the required maximum SAR, e.g., based on regulatory requirements, and the SAR for the actual antenna.

FIG. 1 is a diagram illustrating SAR hotspots in accordance with the techniques described herein. The diagram includes a cross-section 100 of an example antenna prior to performing any of the techniques described herein that reduce SAR. FIG. 1 also illustrates a SAR hotspot 102 and how it relates to a graph of example results that may be determined by, for example, a SAR measurement or a SAR simulation, as described herein. The SAR measurement is a measure of the rate at which energy is absorbed by, for example, the human body, when exposed to an RF electromagnetic field. The measurement may be made, for example, using engineering test equipment. Alternatively, simulation tools may be used to determine or estimate one or more hotspot locations. Hotspot locations are areas on an antenna where an RF transmission using that antenna contributes to higher SAR values at a point of interest. The point of interest may be a location of a person or a portion of a person's body relative to a mobile communication device when the mobile communication device is in use by the person. Hotspots may be caused by denser current distribution in an antenna. A graph of SAR contribution as a function of location along an antenna and a regulatory maximum 106 are indicated in the graph. A second cross section 108 of the antenna after adding a recess 110 is also illustrated in the graph. The antenna includes a planar surface 116.

As illustrated in FIG. 1, the SAR level may be reduced by determining the location of a SAR hotspot 102 and adding recess 110 to the antenna, as illustrated by SAR measurements 114. At SAR hotspot 102 the rate at which energy is absorbed by the human body (at some specified location of interest) when exposed to an RF electromagnetic field 104 is above regulatory maximum 106.

The techniques of this application may be applied more generally to, for example, decrease SAR even if SAR is already below a regulatory maximum. Thus, it will be understood that, in some examples, the SAR level may simply be reduced from some local maximum level 112 that is already below regulatory maximum 106. The reduction of local maximum level 112 that is below regulatory maximum 106 may be performed using the techniques described herein. Furthermore, the techniques described herein may be applied to multiple maximum levels, such as local maximum levels (not shown) which are be above regulatory maximum 106, multiple local maximum levels 112 below regulatory maximum 106, and maximum levels such as SAR hotspot 102.

As described herein, some examples may change the geometry of an antenna to reduce SAR rather than using non-transmitting structures to reduce SAR, e.g., by shielding. By changing the geometry of the antenna rather than using shielding, destructive methods of reducing SAR (shielding), i.e. methods that decrease power output of the antenna by partially blocking the transmission of the antenna may be avoided. Thus, it can be possible to design and produce a SAR compliant antenna without using destructive methods of reducing SAR. This may avoid wasting transmit power that will be filtered out. This may lead to savings in batteries or another power source used by a mobile communication device using the techniques described herein. This may lead to the use of a smaller battery, longer battery life, lower heat generation, or some combination of these depending on, for example, the battery size selected. Additionally, as compared to an absorber solution, such a design might be less expensive because absorbers or filters may not be required. In some examples, however, a combination of destructive and non-destructive measures may be used.

The systems and methods described may be used in conjunction with the industrial design. The industrial design of the product may generally impact the shape of an antenna within the product. Accordingly, the techniques described herein may be used to create a SAR compliant antenna within the required industrial design shape generally without the use of shielding.

Some examples relate to an antenna design including a plane of the antenna where hotspots are recessed away from the plane of the SAR measurement. For example, an antenna may include a surface forming an antenna structure. Such a surface may be a plane. The antenna may further include a recess in the surface of the antenna at a recess location. Generally, the recess location would be a hotspot when the surface of the antenna is not recessed. Thus, the recess location may be based on a location of the hotspot. The hotspot comprises an area of increased SAR above a predetermined limit. The location of the hotspot may be determined as part of manufacturing the antenna prior to the addition of the recess. The recess may be added to reduce SAR by recessing away hotspots from the antenna surface. In some examples, the antenna may be in the form of a plane. Accordingly, SAR emitting elements may be moved away from the plane of the antenna and in some examples the SAR emitting elements may be planer with each other. Some example methods identifying a hotspot and change geometry of hotspot to make sure it is in a subsumed plane to push the hotspot down, away from the rest of the antenna.

Figure 2:
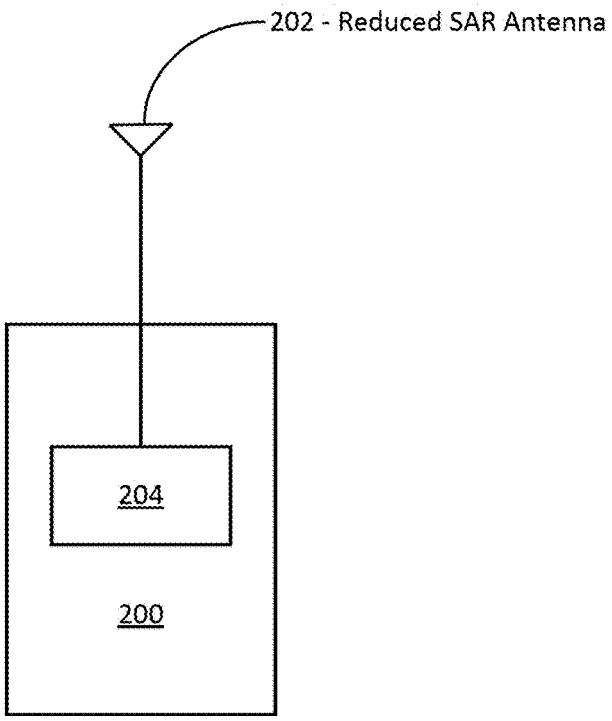
FIG. 2 is a diagram illustrating mobile communication device including a reduced SAR antenna in accordance with the techniques described herein.

FIG. 2 is a diagram illustrating a mobile communication device 200 including a reduced SAR antenna 202 in accordance with the techniques described herein. Reduced SAR antenna 202 may be used to convert electrical signals from transceiver 204 of mobile communication device 200 into radio waves for transmission from mobile communication device 200 to other devices and convert radio waves received at mobile communication device 200 into electrical signals for further processing by mobile communication device 200. Additionally, reduced SAR antenna 202 may be used by mobile communication device 200 to decrease SAR received by a human body, e.g., when using mobile communication device 200.

Transceiver 204 may be a device comprising both a transmitter and a receiver which are combined and share common circuitry or a single housing. Generally, when no circuitry is common between transmit and receive functions, the device may be referred to as a transmitter-receiver. In some examples, a transmitter-receiver may be used in place of transceiver 204.

In other examples, transceiver 204 may be replaced by a transmitter without a receiver. Generally, the antenna features described herein relate to the transmission of signals from reduced SAR antenna 202 rather than the reception of signals by reduced SAR antenna 202. SAR is generally a function of the transmission of signals because SAR is a measure of the rate at which energy is absorbed by the human body when exposed to a radio frequency (RF) electromagnetic field due to transmission of such RF electromagnetic fields.

Reduced SAR antenna 202 in mobile communication device 200 may include a surface forming an antenna structure as illustrated by surface 212 in FIG. 1. A recess, such as recess 110 of FIG. 1 may be in a surface forming reduced SAR antenna 212 at a recess location. The recess location may be based on a location of a hotspot, such as hotspot 102 of FIG. 1. The location of the hotspot may be determined prior to an addition of the recess, which may be added to reduce SAR and this form a reduced SAR antenna such as reduced SAR antenna 202.

While FIG. 2 include a mobile communication device 200, it will be understood that the techniques described herein may be applied to an antenna, antennas, and antenna systems used in conjunction with other electronic communication devices, including communication devices at a fixed geographic location.

Figure 3:
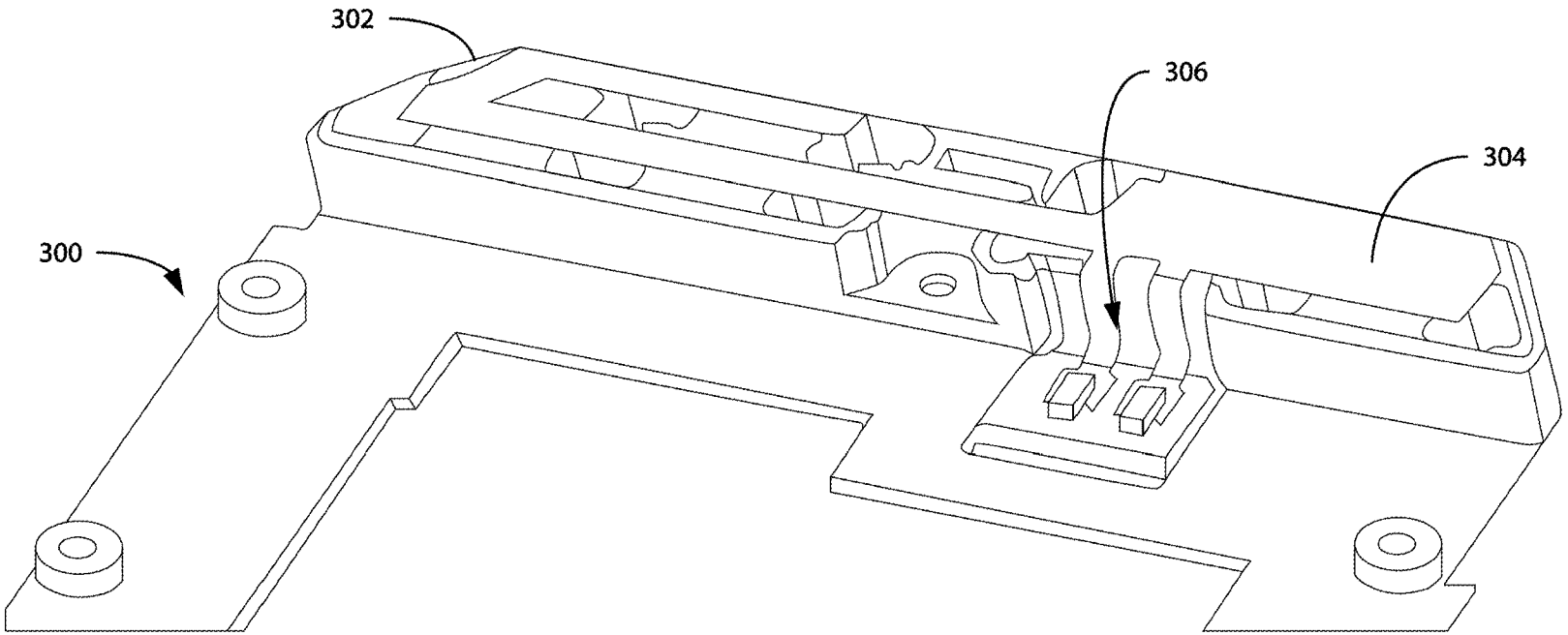
FIG. 3 is a diagram illustrating a portion of a device including an antenna with a SAR hotspot on a patch near an antenna feed.

FIG. 3 is a diagram illustrating a portion of a device 300 including an antenna 302 with a SAR hotspot 304 on a patch near an antenna feed 306. As described herein, in general, this disclosure describes techniques that reduce the SAR level of antenna 302. In general, some examples techniques may reduce the SAR level by determining the location for SAR hotspot 304 on antenna 302. This may be done for a particular frequency or frequency band. In some examples, multiple frequencies, multiple frequency bands, or some combination of both frequencies and frequency bands may be tested to determine locations of multiple hotspots. To the extent that the introduction of one or more recesses or notches may impact locations of other hotspots at the same or other frequencies or frequency bands, an iterative process might be used to determine final locations for recesses or notches. For example, antenna 302 may be re-tested or re-simulated after one or more recesses or notches have been added. Minor antenna tuning may also be needed to compensate for the change of antenna geometry due to an addition of the recess.

Figure 4:
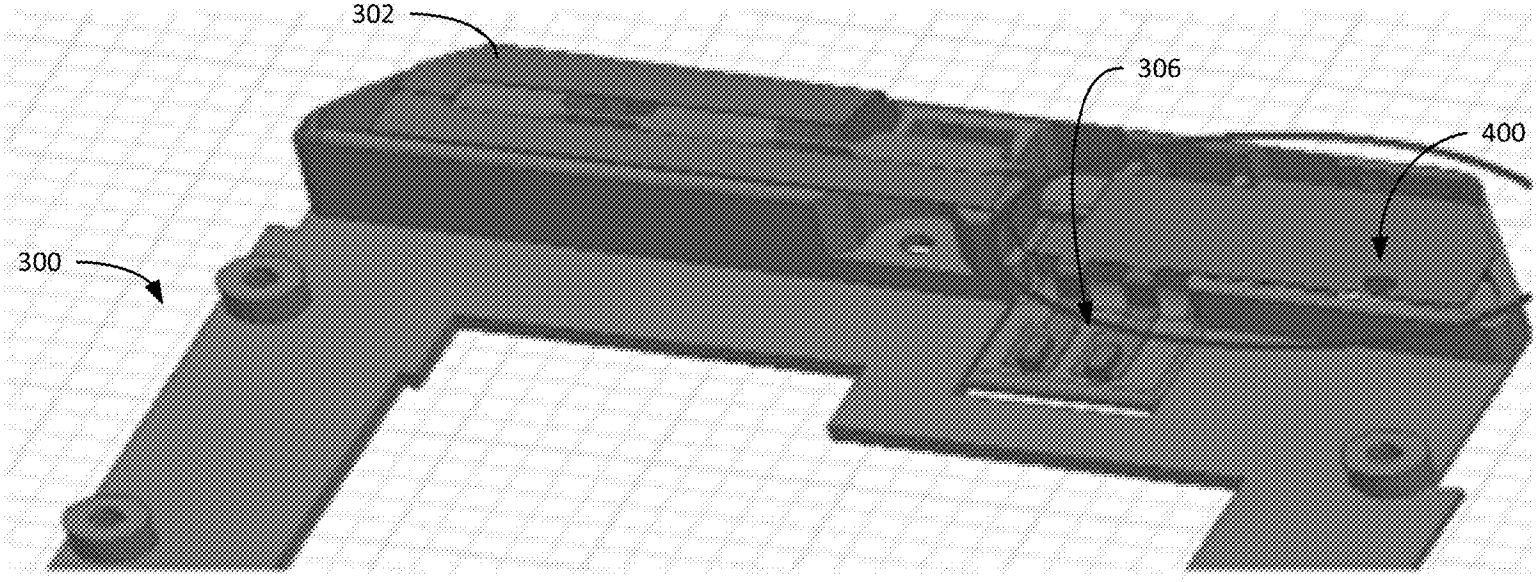
FIG. 4 is a diagram illustrating a portion of a device including an antenna with a reduced SAR area in accordance with the techniques described herein.

FIG. 4 is a diagram illustrating a portion of a device 300 including an antenna 302 with a reduced SAR area in accordance with the techniques described herein. Unlike FIG. 3, however, FIG. 4 further illustrates a recess 400 which may eliminate SAR hotspot 304 (of FIG. 3). Thus, as illustrated in FIG. 3, FIG. 4 includes a portion of device 300 including antenna 302. Instead of SAR hotspot 304 on the patch near an antenna feed 306, recess 400 is illustrated. Recess 400 decreases SAR and may eliminate SAR hotspot 304 completely.

FIG. 4 illustrates an example that includes recess 400 implemented in an mobile hand set product to reduce SAR in accordance with the techniques described here. The reduction in SAR may be used to meet regulatory compliance or otherwise generally reduce SAR. Accordingly, reductions in SAR beyond regulatory compliance are also possible. Minor antenna tuning may be needed to compensate for the change of antenna geometry due to an addition of recess 400.

As described above, SAR resulting from radiation in the near field generally decreases with separation distance from the radiating elements such as the antenna or antennas. Accordingly, RF energy absorbed by a human body may be reduced by increasing the distancing from the human body to areas of radiating elements causing high RF energy absorption by the human body, e.g., areas of an antenna contributing relatively more energy to cause a high SAR. Thus, increasing distance from such areas may lead to a reduced SAR. The increase in distance may be accomplished by introducing recess 400 into the surface of antenna 302 at a recess location such as SAR hotspot 304 illustrated in FIG. 4. SAR hotspot 304 may be eliminated, reduced, or simply moved away by the introduction of recess 400

The location of recess 400 may be based on the location of SAR hotspot 304, which is a location on a surface of antenna 302 contributing a relatively large amount of energy to a SAR and potentially causing the SAR value to be above a predetermined limit, a maximum, or any other SAR value that is higher than desired and may be reduced using the techniques described herein. Recess 400 illustrates a complete removal of a portion of antenna 302 by using a hole added to antenna 302 at a location that was SAR hotspot 304. Other examples may use a notch through a portion of an antenna or other removal methods or distancing methods. For example, the recess may be formed by bending a location on a surface of an antenna contributing to a high SAR away from an area of interest where SAR is measured.

Generally the shape of antenna 302 will have the largest impact on the performance of antenna 302. The other components around antenna 302 may also have an impact on the performance of antenna 302. The impact of the components around antenna 302 may generally be minimal, however.

Figure 6:
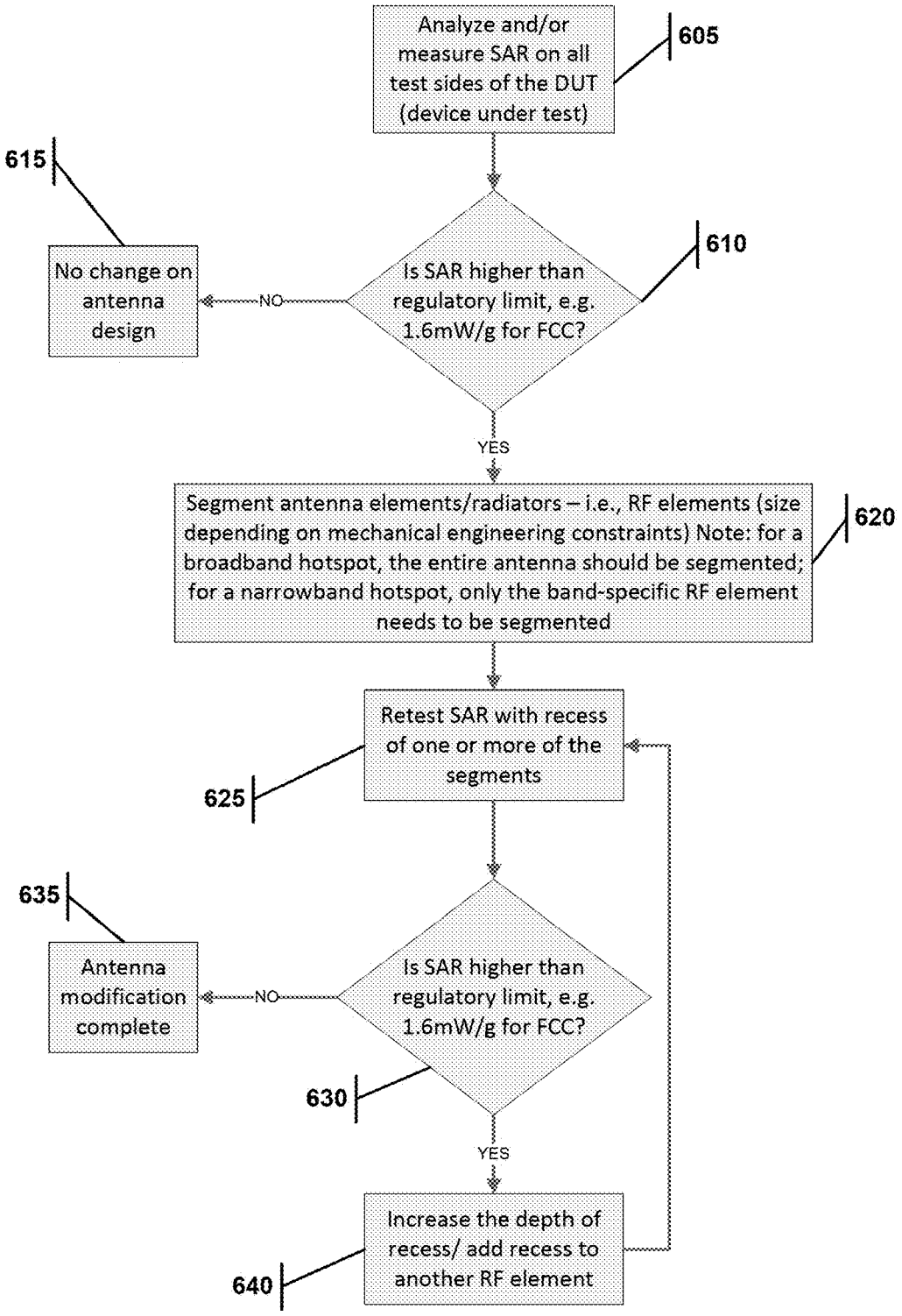
FIG. 6 is a flowchart illustrating an example method for reducing SAR from an antenna in accordance with the techniques described herein.

FIG. 6 is a flowchart illustrating an example method that may be used to form an antenna, antennas, or an antenna system in accordance with the techniques described herein. The example method may reduce SAR from the antenna, antennas, or antenna system by adding a recess 400 to antenna 302 at the location of a SAR hotspot 304. Recess 400 may distance the area of SAR hotspot 304 away from antenna 302. More specifically, for planar antennas, the recess may distance the area of the hotspot away from the plane of the rest of the antenna. The recess may also distance the area of the hotspot away from the area of SAR measurement. This will generally lower the SAR measurement, at least with respect to energy received from that particular hotspot. The recess location may be based on a location of a hotspot, e.g., as determined prior to the addition of the recess. The recess may change the geometry of the antenna, change the geometry of the SAR hotspot 304 area of the antenna, or both. These changes in geometry may push the hotspot away from the rest of the antenna.

One would first determine a location of SAR hotspot 304 on a surface of antenna 302. SAR hotspot 304 may be an area of increased SAR above predetermined limit 106 as illustrated in FIG. 1 (500). In some examples, the determination may be made by taking measurements on antenna 302 when a specific frequency or frequency range of interest is transmitted from antenna 302. In other examples, the determination may be made using a simulation of antenna 302 for a specific frequency or frequency range of interest. As described herein, multiple frequencies or frequency ranges may be used.

In some examples, engineering test equipment, simulation tools, or both may be used to determine one or more hotspot locations. The hotspot locations may be caused by denser current distribution. The hotspot location or hotspot locations on or along a surface of an antenna element or antenna elements may be frequency dependent. Thus, the testing or simulation may be performed for a specific frequency or band of frequencies. There may be one or more SAR hotspots that may exceed FCC or other regulatory limits, e.g., for a frequency or band of frequencies of interest. Thus, the hotspots would need some countermeasure to reduce the intensity of SAR in order to be in compliance with SAR regulations. In some examples, SAR hotspots may typically be concentrated in an area on one of many test surfaces. The hotspots may be closer to antenna elements with high current density.

Then one would introduce recess 400 in the surface of the antenna 302 at a recess location, the recess location based on the location of the SAR hotspot 304 (502). In some examples, the recess location and the location of the hotspot are the same location, although the hotspot may be eliminated, reduced, or simply moved away by the introduction of the recess. In some examples, multiple hotspot locations may be determined. Thus, recesses may be introduced at multiple locations, e.g., the locations of the multiple hotspots. In other examples, however, a combination of recesses and shielding may be used. For example, shielding at least one of the multiple hotspot locations may be used with recesses used in other hotspots.

As described herein, the determination of the location of the hotspot or hotspots on the surface of the antenna may be made for a specific signal frequency, a specific frequency band or both. In other examples, the determination of the location of the hotspot or hotspots on the surface of the antenna may be made for multiple specific frequencies, multiple frequency bands, or both. The specific signal frequency, frequencies, frequency band, or frequency bands may be the signal frequency, frequencies, frequency band, or frequency bands used for transmission of signals by antenna 302 when a mobile communication device using the antenna is in operation.

Figure 5:
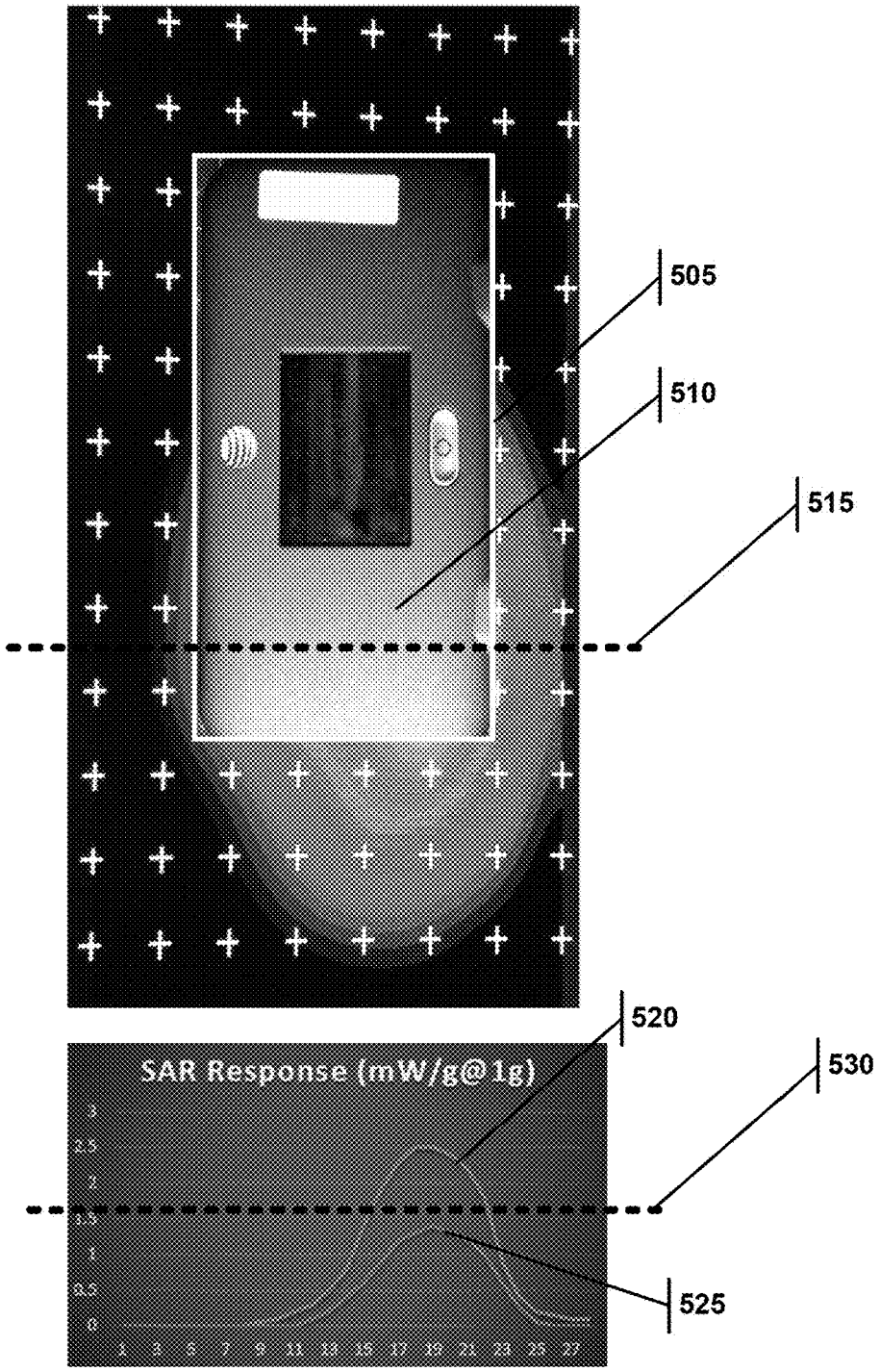
FIG. 5 illustrates a hotspot on a mobile device and the SAR response with an without mitigation as disclosed herein.

FIG. 5 illustrates the hotspot of a mobile device 505. The lighter areas 510 have the highest RF energy value and indicate the presence of a hotspot, and the RF energy diminishes as a function of a distance from the center of the hotspot. The graph at the bottom of FIG. 5 is taken along the line 515, which represents the spot where a user of the device would experience the most RF energy exposure. The graph at 520 shows the SAR response (i.e, RF energy exposure) without SAR mitigation as disclosed here—i.e., no recess as in FIG. 3, while 525 illustrates the SAR response with SAR mitigation as in FIG. 4. The recess of the hotspot has resulted in the reduction of SAR by 50%. More importantly, the SAR has been reduce below the 1.6 mW/g regulatory threshold 530.

Using the example method illustrated in FIG. 6, an antenna with a reduced SAR may be designed and/or manufactured. Such an antenna may include a surface forming an antenna structure and a recess in the surface of the antenna at a recess location, the recess location may be based on a location of a hotspot determined prior to an addition of the recess. The recess may be added to reduce SAR.

Using the example method illustrated in FIG. 6, an electronic device including such an antenna may also be designed, manufactured, or both. The electronic device may include a transmitter and an antenna. The antenna may be coupled to the transmitter and the antenna may have a reduced SAR using the techniques described herein. For example, the antenna may include a surface forming an antenna structure and a recess in the surface of the antenna at a recess location. The recess location would be a hotspot when the surface of the antenna is not recessed, the hotspot comprising an area of increased SAR above a predetermined limit.

Turning to FIG. 6, the SAR of the device is measured at step 605. If the measured SAR is less than the regulatory limit (step 610) then no change in the design is necessary (step 615). If the measured SAR exceeds the regulatory limit, then various emitters (i.e., antenna or radiators) should be segmented and tested at step 620. For example a broadband hotspot may include RF energy at several frequencies and may be emitted from several RF elements. The design of RF element may be changed to reduce the overall measured SAR. A recess may be introduced to the RF element and then the device is re-measured for SAR (step 625). If the measured SAR for the device is less than the regulatory limit (step 630) then the antennae modification is complete (step 635). If, however, the measured SAR exceeds the regulatory limit, then a further change in the design is necessary and the depth of the recess may be increased and/or a recess may be added to another RF element (step 640). The device with the now deeper recess/new recess is retested at step 625 and the process continues until the design achieves an acceptable SAR measurement at step 630.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." *Phillips* v. *AHW Corp.,* 415 F.3d 1303, 1323 (Fed. Cir. 2005)(en banc).

The invention claimed is:

1. A method of reducing specific absorption rate (SAR) from an antenna comprising:

determining locations of multiple hotspots on a surface of the antenna, each hotspot comprising an area of increased SAR above a predetermined limit;

introducing multiple recesses in the surface of the antenna, the location and depth of the multiple recesses based on the location and strength of the multiple hotspots.

2. The method of claim 1, wherein the recess locations are at the location of the hotspots.

3. The method of claim 1, wherein the predetermined limit comprises a regulatory limit.

4. The method of claim 3, wherein the regulatory limit comprises a Federal Communications Commission (FCC) limit.

5. The method of claim 1, further comprising shielding at least one of the multiple hotspots.

6. The method of claim 1, wherein the determination of the location of the hotspots on the surface of the antenna is made for a specific signal frequency, the specific signal frequency used for transmission of signals by the antenna.

7. An antenna with a reduced specific absorption rate (SAR), the antenna comprising:

a surface forming an antenna structure; and multiple recesses in the surface of the antenna at recess locations, wherein the recess locations would be a hotspot when the surface of the antenna is not recessed, the hotspot comprising an area of increased SAR above a predetermined limit.

8. The antenna of claim 7, wherein the recess locations are at the location of the hotspots.

9. The antenna of claim 7, wherein the recess reduces SAR below a regulatory limit.

10. The antenna of claim 9, wherein the regulatory limit comprises an FCC limit.

11. The antenna of claim 7, further comprising shielding at least one of multiple hotspot locations.

12. The antenna of claim 7, wherein the location of the hotspots on the surface of the antenna is for a specific signal frequency, the specific signal frequency used for transmission of signals by the antenna.

13. An electronic device comprising:

a transmitter; and an antenna coupled to the transmitter, the antenna having a reduced specific absorption rate (SAR), the antenna including:

a surface forming an antenna structure; and multiple recesses in the surface of the antenna at recess locations, wherein the recess locations would be a hotspot when the surface of the antenna is not recessed, the hotspot comprising an area of increased SAR above a predetermined limit.

14. The electronic device of claim 13, wherein the recess locations are at the location of the hotspots.

15. The electronic device of claim 13, wherein the location of the hotspots on the surface of the antenna is for a specific signal frequency, the specific signal frequency used for transmission of signals by the antenna.

* * * * *